US009090366B2

(12) United States Patent
Draghetti

(10) Patent No.: US 9,090,366 B2
(45) Date of Patent: Jul. 28, 2015

(54) DEVICE FOR PACKAGING A PRODUCT IN AN ENVELOPE

(75) Inventor: Fiorenzo Draghetti, Medicina (IT)

(73) Assignee: GIMA TT S.R.L., Ozzano dell'Emilia (BO) (IT)

( * ) Notice: Subject to any disclaimer, the term of this patent is extended or adjusted under 35 U.S.C. 154(b) by 917 days.

(21) Appl. No.: 13/264,400

(22) PCT Filed: Apr. 13, 2010

(86) PCT No.: PCT/IT2010/000158

§ 371 (c)(1),
(2), (4) Date: Oct. 14, 2011

(87) PCT Pub. No.: WO2010/119474

PCT Pub. Date: Oct. 21, 2010

(65) Prior Publication Data

US 2012/0031044 A1 Feb. 9, 2012

(30) Foreign Application Priority Data

Apr. 17, 2009 (IT) ..... TO2009A0296

(51) Int. Cl.

| | |
|---|---|
| ***B65B 11/48*** | (2006.01) |
| ***B65B 11/16*** | (2006.01) |
| ***B65B 19/22*** | (2006.01) |
| ***B65B 19/24*** | (2006.01) |

(52) U.S. Cl.

CPC ..... *B65B 11/16* (2013.01); *B65B 19/221* (2013.01); *B65B 19/24* (2013.01)

(58) Field of Classification Search

CPC .... B65B 11/00; B65B 11/004; B65B 11/008; B65B 11/04; B65B 11/06; B65B 11/28; B65B 11/30; B65B 11/36; B65B 11/48

USPC ..... 53/321, 203, 148, 228, 221

See application file for complete search history.

(56) References Cited

U.S. PATENT DOCUMENTS

| | | | | |
|---|---|---|---|---|
| 3,372,526 | A | 3/1968 | Anderson | |
| 3,735,767 | A * | 5/1973 | Kruse et al. | 131/283 |
| 3,802,325 | A * | 4/1974 | Bardenhagen et al. | 493/17 |
| 3,810,314 | A * | 5/1974 | Anderson | 53/372.5 |
| 3,911,643 | A * | 10/1975 | Davies | 53/170 |
| 3,956,110 | A * | 5/1976 | Seragnoli | 209/3.1 |
| 4,241,564 | A | 12/1980 | Quarenghi | |

(Continued)

FOREIGN PATENT DOCUMENTS

| | | |
|---|---|---|
| DE | 2746431 A1 | 4/1979 |
| EP | 1854726 A2 | 11/2007 |

(Continued)

OTHER PUBLICATIONS

Int'l Search Report issued Aug. 11, 2010 in Int'l Application No. PCT/IT2010/000158; Written Opinion.

*Primary Examiner* — Gloria R Weeks

(74) *Attorney, Agent, or Firm* — Panitch Schwarze Belisario & Nadel LLP

(57) ABSTRACT

A device is provided for winding an envelope (A) around a product (B), such as a group of cigarettes or the like. The product is to be packaged in a corresponding box-shaped body, or packet. The device includes an apparatus (10) for winding the envelope (A) around the product (B) and an apparatus (20) adapted to supply the product (B) and the envelope (A) to the winding apparatus (10).

15 Claims, 13 Drawing Sheets

(56) References Cited

U.S. PATENT DOCUMENTS

| | | | | |
|---|---|---|---|---|
| 4,603,534 | A | 8/1986 | Focke | |
| 5,168,690 | A * | 12/1992 | Quadrana | 53/575 |
| 5,540,034 | A * | 7/1996 | Focke | 53/444 |
| 5,771,666 | A * | 6/1998 | Bertuzzi et al. | 53/466 |
| 6,189,296 | B1 * | 2/2001 | Spatafora et al. | 53/461 |
| 6,286,291 | B1 * | 9/2001 | Tale' et al. | 53/456 |
| 6,439,239 | B1 * | 8/2002 | Spatafora et al. | 131/58 |
| 6,820,398 | B2 * | 11/2004 | Tale' et al. | 53/466 |
| 6,854,243 | B2 * | 2/2005 | Sendo et al. | 53/234 |
| 6,964,148 | B2 * | 11/2005 | Spatafora | 53/466 |
| 7,650,730 | B2 * | 1/2010 | Bertuzzi et al. | 53/444 |
| 7,827,767 | B2 | 11/2010 | Bertuzzi et al. | |
| 7,900,424 | B2 * | 3/2011 | Bertuzzi et al. | 53/466 |
| 8,037,664 | B2 * | 10/2011 | Squarzoni et al. | 53/466 |
| 8,266,877 | B2 * | 9/2012 | Biondi et al. | 53/466 |
| 8,418,431 | B2 * | 4/2013 | Bertuzzi et al. | 53/466 |
| 2001/0047639 | A1 * | 12/2001 | Tale' et al. | 53/234 |
| 2001/0052217 | A1 * | 12/2001 | Spatafora | 53/234 |
| 2004/0011002 | A1 * | 1/2004 | Sendo et al. | 53/234 |
| 2004/0255559 | A1 * | 12/2004 | Spatafora | 53/466 |
| 2006/0254212 | A1 * | 11/2006 | Ghini et al. | 53/148 |
| 2007/0266676 | A1 * | 11/2007 | Biondi et al. | 53/234 |
| 2008/0134636 | A1 * | 6/2008 | Drenguis et al. | 53/234 |
| 2009/0077929 | A1 * | 3/2009 | Bertuzzi et al. | 53/420 |
| 2009/0199515 | A1 * | 8/2009 | Bertuzzi et al. | 53/466 |
| 2009/0288371 | A1 * | 11/2009 | Squarzoni et al. | 53/456 |
| 2010/0132312 | A1 * | 6/2010 | Biondi et al. | 53/466 |
| 2011/0041463 | A1 * | 2/2011 | Squarzoni et al. | 53/461 |
| 2011/0302886 | A1 * | 12/2011 | Ghini et al. | 53/444 |
| 2012/0031044 | A1 * | 2/2012 | Draghetti | 53/203 |
| 2012/0174534 | A1 * | 7/2012 | Cavazza et al. | 53/463 |
| 2012/0285120 | A1 * | 11/2012 | Draghetti | 53/203 |

FOREIGN PATENT DOCUMENTS

| | | | |
|---|---|---|---|
| GB | 1223578 | A | 2/1971 |
| GB | 2164622 | A | 3/1986 |

* cited by examiner

FIG. 7d
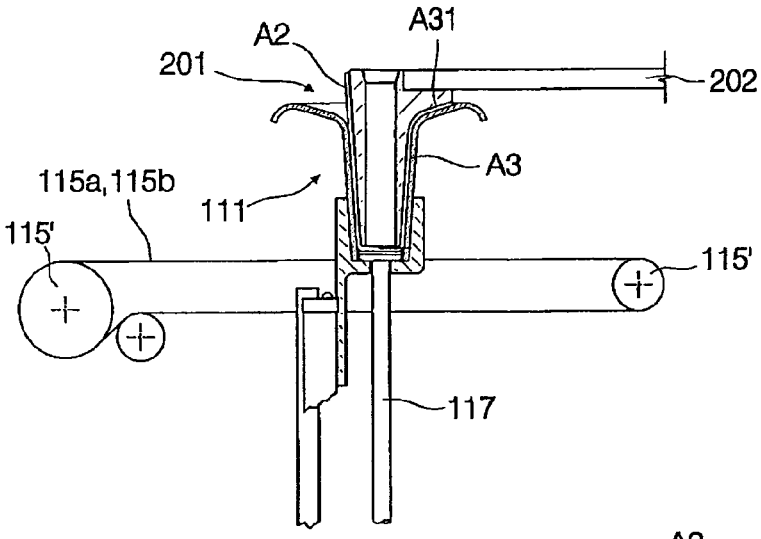
FIG. 7e
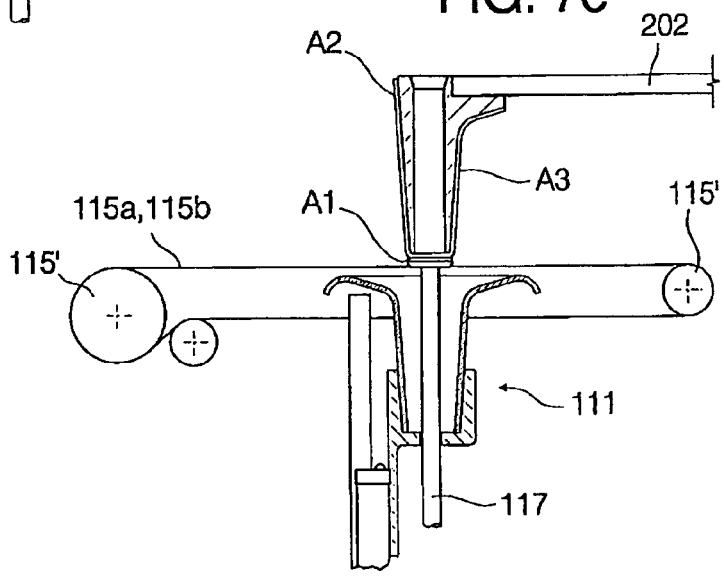
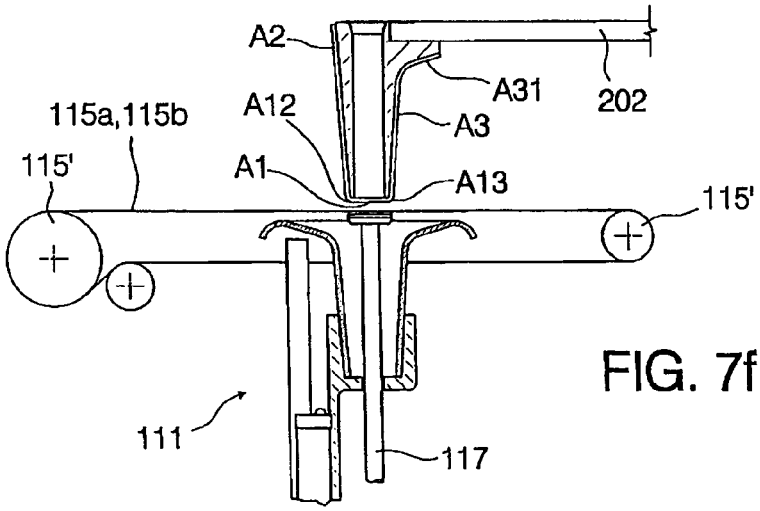
FIG. 7f

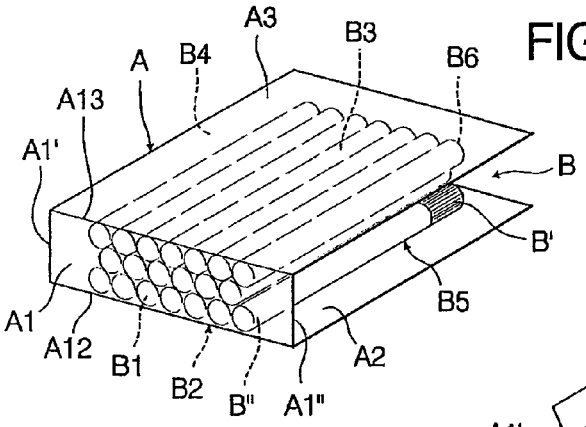
FIG. 8a
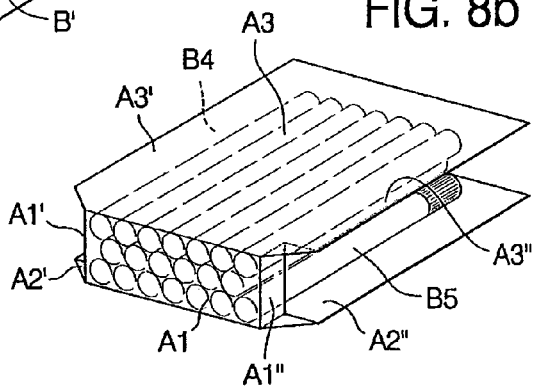
FIG. 8b
FIG. 8c
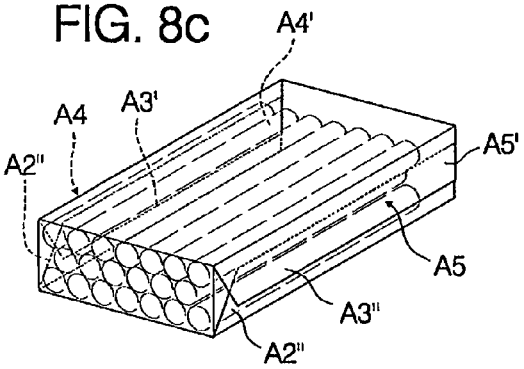
FIG. 8d
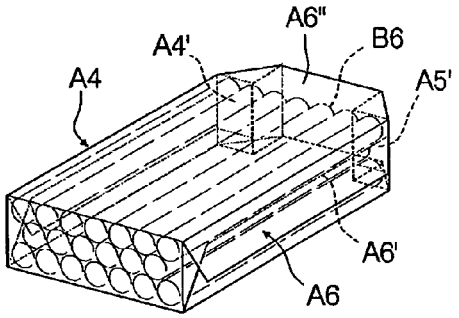
FIG. 8e
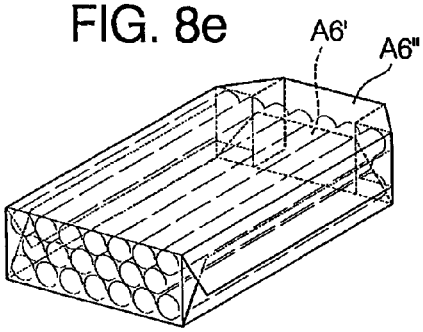
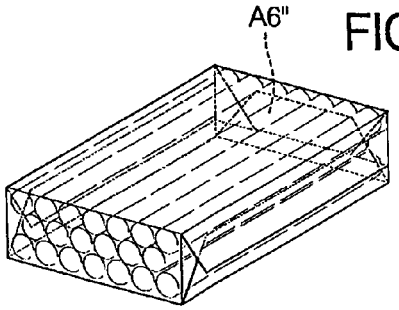
FIG. 8f

DEVICE FOR PACKAGING A PRODUCT IN AN ENVELOPE

CROSS-REFERENCE TO RELATED APPLICATION

This application is a Section 371 of International Application No. PCT/IT2010/000158, filed Apr. 13, 2010, which was published in the English language on Oct. 21, 2010, under International Publication No. WO 2010/119474 A1, and the disclosure of which is incorporated herein by reference.

BACKGROUND OF THE INVENTION

The present invention relates to a device for packaging a product in an envelope.

Said product is, in particular, defined by a group of articles, specifically defined by cigarettes or the like, to be packaged in a corresponding box-shaped body, or packet, preferably made of paperboard.

Currently, to package cigarettes, they must be wrapped inside an envelope, or wrapping sheet of various type, usually made of aluminium film, which completely wraps the product for the purpose of preserving the aroma, and subsequently be inserted in a corresponding box-shaped body.

For this purpose, prior art has proposed various systems, such as those described in the documents U.S. Pat. No. 4,603,534 and EP-A-1854726, which comprise a longitudinal channel, into which cigarettes are supplied until encountering a small sheet, laid transversely to the movement of the cigarettes, which is engaged and drawn by the cigarettes, forming a sort of "U" around these cigarettes.

However, these systems are composed of a large number of components and are particularly bulky and difficult to service.

In particular, these prior art systems require the use of bulky mechanisms to supply the sheet in the advancement channel of the cigarettes and specific means adapted to weaken the sheet, according to respective pre-folded lines, immediately before it is picked up by the cigarettes, in order to prevent damaging them and to produce a wrapper, bent around the product, which has well-defined bend lines, without producing unwanted rounded edges.

These prior art devices are, all in all, burdensome, bulky and difficult to configure in the case of variations to the specifications of the packaging to be implemented.

BRIEF SUMMARY OF THE INVENTION

The object of the present invention is to overcome one or more of the aforesaid drawbacks of prior art.

Therefore, there is provided a device for winding an envelope around a product, wherein said product is, in particular, defined by a group of articles, preferably shaped as elongated elements, specifically defined by cigarettes or the like, and said envelope is, in particular, shaped as a small plane sheet, preferably made of an aluminium film or the like; wherein the device comprises means for winding said envelope around said product, and is characterised in that it comprises means that are adapted to supply said product and said envelope, together, to said winding means.

In this way, it is possible to supply the envelope and the product to the winding means without excessive congestion of the area surrounding these winding means with separate supplying means, as is instead the case in prior art devices.

Other advantageous aspects of the present device are set forth in the appended claims.

The technical features of the invention, according to the aforesaid objects, are clearly found in the content of the claims provided below, and the advantages thereof will be more apparent in the following detailed description, provided with reference to the accompanying drawings, which represent, purely by way of example, a non-limiting embodiment, wherein:

BRIEF DESCRIPTION OF THE DRAWINGS

FIGS. 7*a* to 7*f* show a sequence of some steps of association of the envelope with the supplying means of the present device;

FIGS. 8*a* to 8*f* show the sequence of the steps of winding the envelope on the product by the present device;

DETAILED DESCRIPTION OF THE INVENTION

Figure 1:
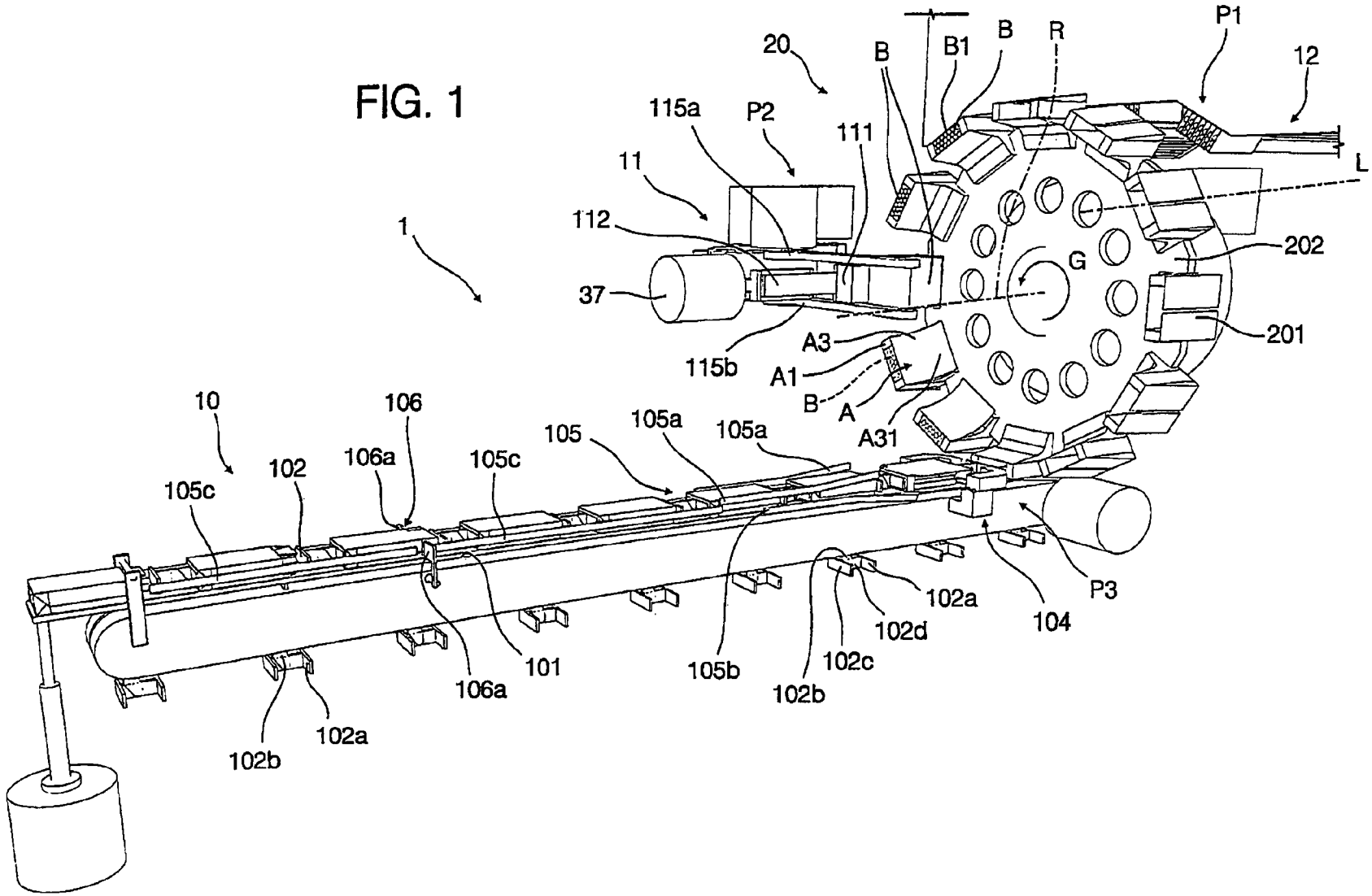
FIG. 1 shows a perspective front view of a preferred embodiment of the device according to the present invention.
Figure 2:
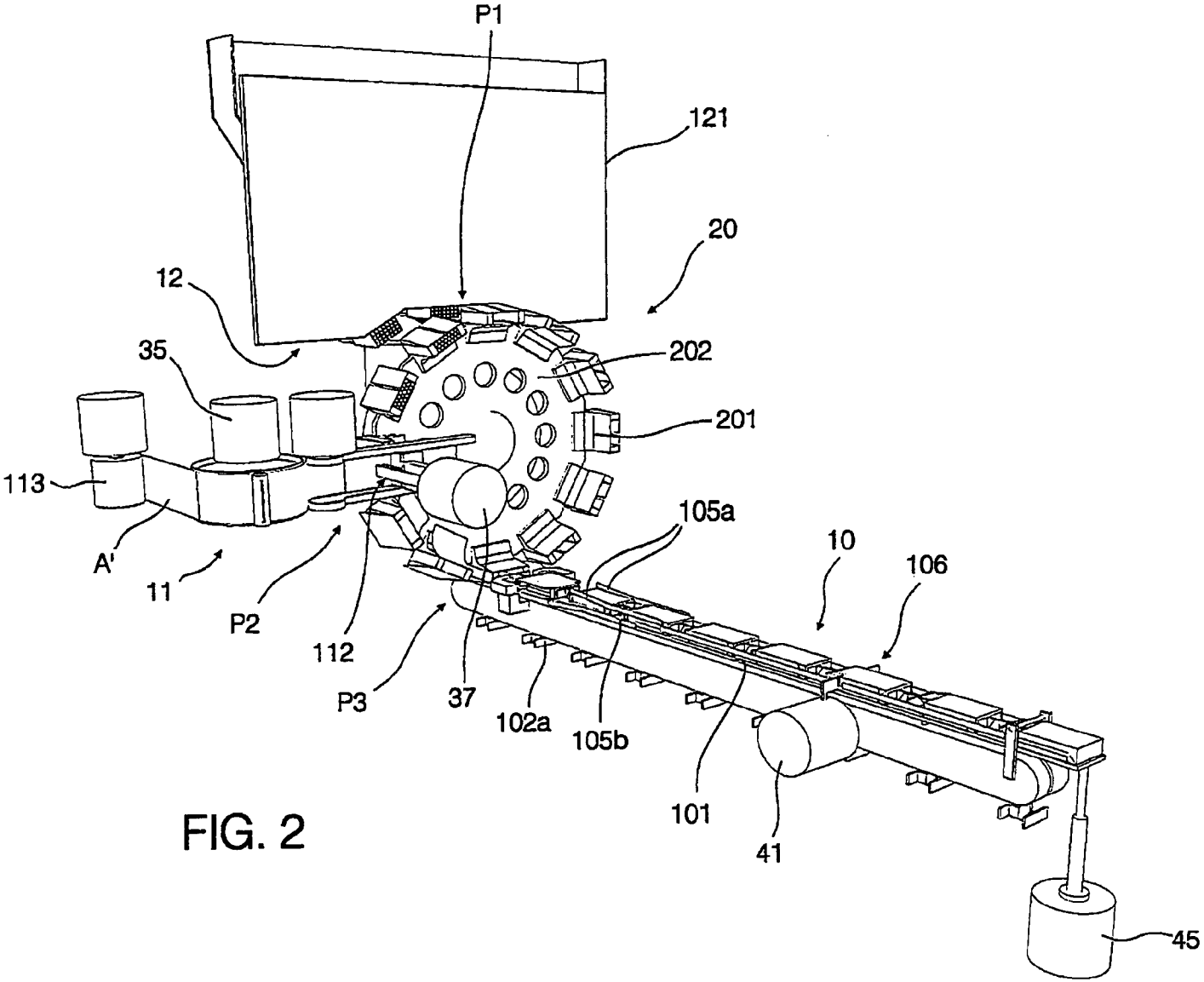
FIG. 2 shows another perspective front view of the device of FIG. 1.
Figure 3:
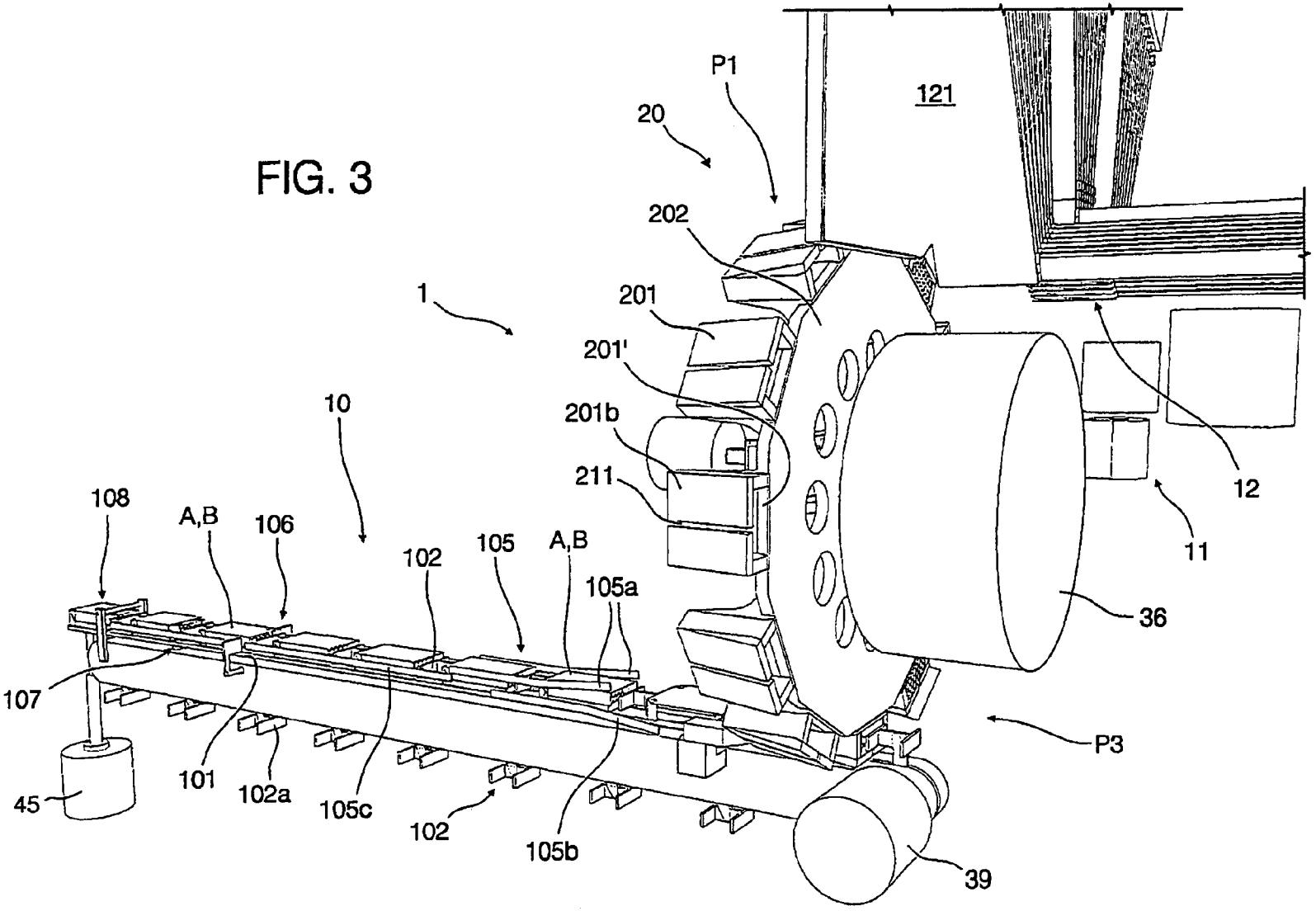
FIG. 3 shows a perspective rear view of the device of FIG. 1.

The accompanying Figures show a device, or system, 1 for winding an envelope A around a product B, wherein said product B is, in particular, defined by a group of articles, or elongated elements, specifically defined by cigarettes or the like, having a respective end B', wherein there is provided a filter of the cigarette, and an opposite end B", as shown in FIG. 8*a*.

Once the product B has been wound by the envelope A, it is destined to be subsequently packed in a corresponding box-shaped body, or packet, preferably made of paperboard, not shown in the accompanying figures.

In particular, as can also be deduced with reference to FIG. 8*a*, the group of cigarettes to be wrapped has a bottom, or front, face B1, and a plurality of side faces defined by opposite wide transverse faces B2 and B3, and opposed short side flank faces B4, B5, and by a head, or rear, face B6.

Said bottom and head faces B1 and B6 are generally orthogonal to the side faces of the product, while said side faces have the wide transverse faces B2, B3 and the side flank faces B4, B5 which are mutually orthogonal.

The envelope A, in turn, is shaped as a small plane sheet, generally quadrangular in shape, in particular rectangular, preferably made of aluminium film.

The present device 1 comprises means 10 for winding said envelope A around said product B and means 20 for supplying said product B and said envelope A to said winding means 10.

In practice, common supply means 20 supply said product B and said envelope A, together, to means 10 for winding the envelope, or sheet, A around the product B.

Advantageously, as can be deduced from FIGS. 1 to 4, the means 20 for supply to the winding means 10 define means for associating said product B with said envelope A.

In particular, as can be deduced also with reference to FIGS. 7*a* to 7*f*, the present means 20 for supplying the envelope A and the product B are adapted to advance said envelope A, arranged around the product B, with a portion A1 of said envelope corresponding to the bottom, or front, face B1 of the product B.

Moreover, as shown, the present means 20 for supplying the envelope A and the product B are adapted to advance said envelope A and product B, with the envelope A that extends around, or externally to, said corresponding side faces, in particular shaped as wide transverse faces B2, B3 of the product B.

In practice, there are provided means 20 for supplying the envelope A and the product B, wherein said envelope A is in a condition bent in the general shape of a "V", with a bottom portion A1, from which there extend opposite longitudinal portions A2, A3, that are adapted to be arranged around, or externally to, the opposite transverse faces B2, B3 of the product B.

As shown in FIGS. 7*a* to 7*f*, the longitudinal portion A3 of the bent sheet terminates with a respective end portion A31, which extends substantially perpendicular to the same longitudinal portion A3.

In particular, the present means 20 for supplying the envelope A and the product B are adapted to supply the envelope A with a respective portion A1 that extends perpendicular to the prevalent extension direction L of the product B and with the other portions A2, A3 that are substantially parallel to this prevalent extension direction of the product B.

Moreover, in the present means 20 for supplying the envelope A and the product B, the envelope A is in bent condition and has a bottom portion A1, from which, through corresponding bending lines A12, A13, transverse, or side, portions A2, A3 of the envelope A extend.

In this way, by providing these transverse bending lines A12, A13 in the material of the envelope, this prevents damage to the product and allows simplification of the winding means with respect to those of prior art.

Moreover, according to another aspect, these means 20 for supplying the envelope A and the product B support said envelope A arranged in front of the product B, according to the advancement direction thereof towards the winding means 10, in a station for passage, or transfer, of the product and envelope to the winding means 10, as will be better described in the remainder in the present description.

Moreover, according to a further aspect, there are provided means 20 for supplying the envelope A and the product B, wherein said product B is positioned on said supplying means 20 before positioning said envelope A thereon.

As will be better deduced from the remainder of the present description, the present means 20 for supplying the product are adapted to advance, or supply, said product B so that it extends in parallel, or according to the advancement direction of this product B by the winding means 10.

As shown, the present supplying means 20 are adapted to define supplying means of this envelope A, in bent condition, in particular in condition bent in the general shape of a "V".

According to another aspect, the present supplying means 20 have a station for picking up the product B, a station for picking up the envelope A, downstream of said station for picking up the product B, and a station, downstream, for unloading the envelope and/or the product B.

Said stations are indicated with the references P1, P2, P3 in the accompanying figures from 1 to 4.

In practice, the means 20 for supplying the envelope A supply said envelope A according to a circumferential path.

The present supplying means comprise seats 201 for supporting the product B and/or the envelope A and means 202 for supporting and advancing said seats 201.

Advantageously, the supplying means 20 have engaging and holding means for the respective envelope A.

In particular, said holding means are shaped as means for sucking the envelope A on corresponding surfaces of the supplying means.

In particular, said holding means operate on the side portions A2, A3 of the same envelope A, and/or on the perpendicular wing A31 of the envelope.

For this purpose, said holding means are provided on the respective seat 201, and could also be provided, according to other embodiments, not shown, on the supporting and advancing means 202 of the seat 201.

For this purpose, said holding means are shaped as corresponding holes provided on the surface of the respective seat 201, which comes into contact with a corresponding part A2, A3 or A31 of the envelope.

As is apparent from the accompanying figures, said seats 201 for supporting the product B define holding means for a respective envelope A, as said envelope A extends outside and around a respective seat 201 for supporting the product B.

Said seat 201 for supporting the product is, as shown, shaped as a tubular body defining an internal surface 201' for engaging the product B and an external surface 201" for engaging the envelope A.

Figure 4:
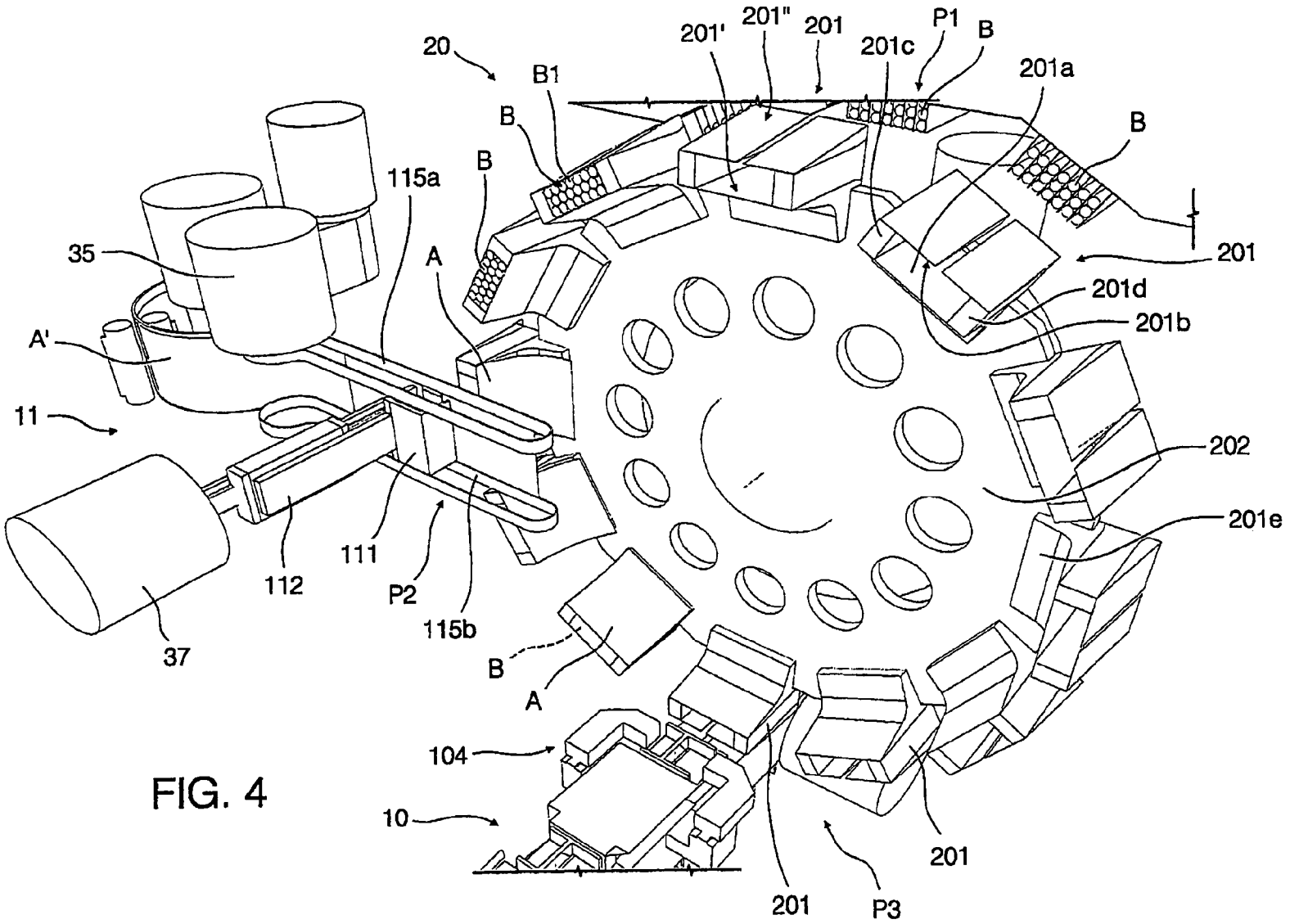
FIG. 4 shows an enlarged view of some components of the device for packaging cigarettes in sheets bent according to the present invention.
Figure 5:
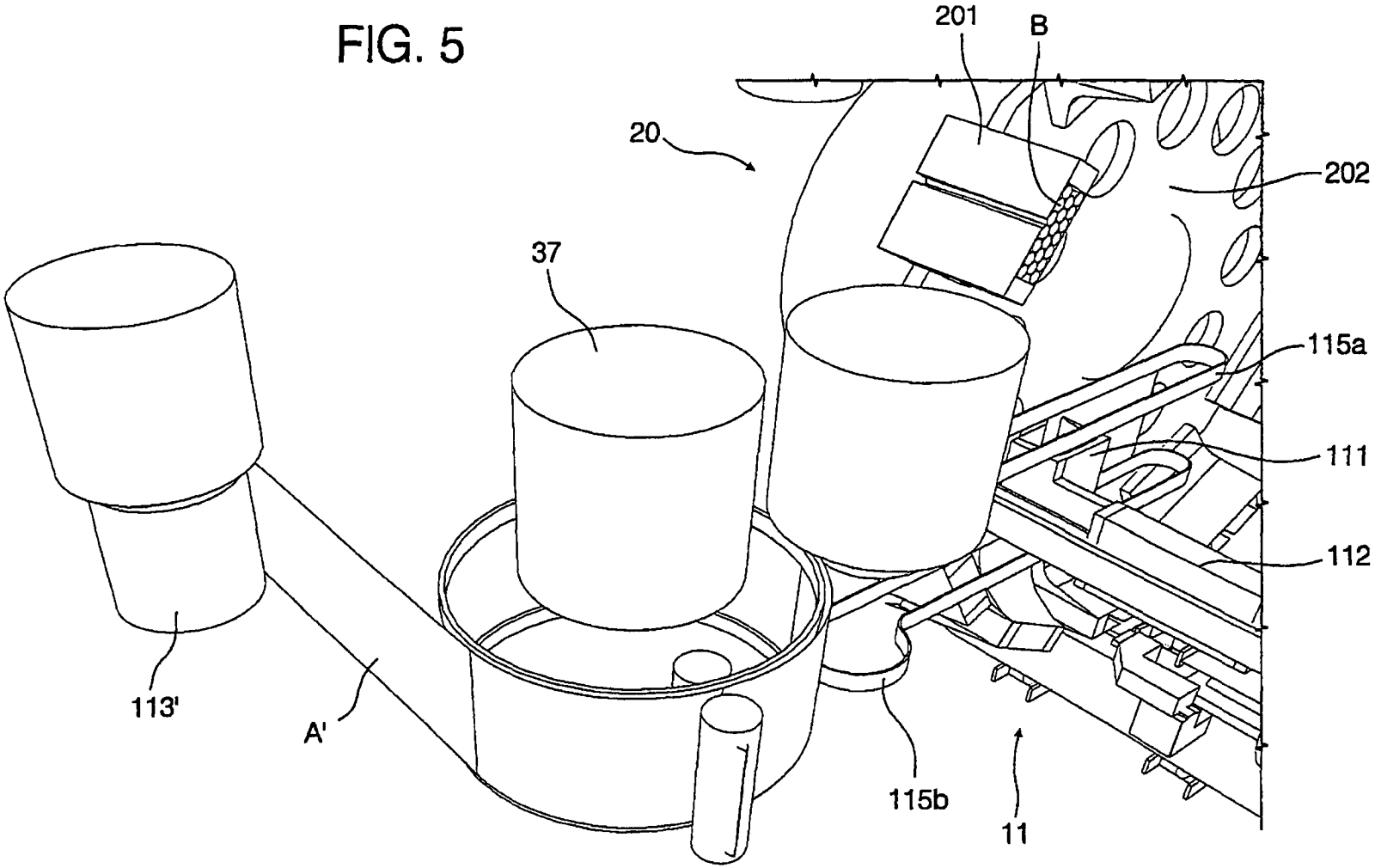
FIG. 5 shows an enlarged view of other components of the present device.

As is shown in particular in FIG. 4, the supporting seat 201 is shaped as a tubular body, with quadrangular section, having a radially internal, or bottom, wall 201*a*, a radially external wall 201*b*, and circumferentially opposed side, or radial, walls 201*c*, 201*d*.

The respective supporting seat 201 holds the corresponding product B with the internal face of the respective walls, while it holds the envelope A with the external face of the internal, or bottom, wall 201*a* and external 201*b* wall.

The respective supporting seat 201 also has a perpendicular surface 201*e*, located at the connection to the advancing means 202, on the extension of the bottom wall 201*a*, that engages and holds the end wing A31 of the envelope A.

As shown, said seat 201 for supporting the product is shaped as a tubular body, open at both longitudinal ends, respectively for said product B to enter said seat 201 and exit from said seat 201B.

As shown, said seat 201 extends according to the advancement direction of the product B and envelope A in the winding means 10.

Moreover, the seat 201 extends perpendicular to the advancement direction of the seats 201.

As shown, said supplying means 20 therefore comprise a rotary body 202 supporting a plurality of seats 201 arranged peripherally around said rotary body, said rotary body 202 being shaped as a flat plate, from which the respective seat 201 projects, extending perpendicularly from said circular plate.

In practice, the seat 201 for supporting the product B projects perpendicularly in a cantilever fashion from the means 202 for supporting and advancing the same seats 201, on the side of these that is facing the winding means 10.

In practice, as shown, the supply means 20 are shaped as a wheel rotating about a respective rotation axis R, according to an angular direction G, moving with intermittent movement, having advancement steps alternated with stop steps.

Said seats 201 extend with the respective axis L parallel to said rotation axis R of the seat carrying wheel.

The rotation axis R of the supplying means 20 extends, preferably, horizontally.

The present device also comprises means 12 for providing the product B to the supply means 20.

Said means 12 for providing the product comprise means for pushing the product towards the supply means 20, which are shaped as a corresponding pushing device, not shown particularly in the accompanying figures, that engages said product B at the rear and pushes it towards and inside the respective supporting seat 201.

The means 12 for providing the product B advance said product with respective extension axis directed according to the extension direction L of the respective seat 201.

Moreover, said means 12 for providing the product advance said elongated elements perpendicular to the advancement plane defined by said means 20 for supplying said product B and/or said envelope A.

Moreover, said means 12 for providing the product B advance said product B with the respective extension axis directed according to the extension direction, and/or advancement direction, of said winding means 10.

Moreover, said means 12 for providing the product B advance said product B with the respective extension axis directed in parallel with the rotation axis R of said supply means 20.

In particular, a plurality of products B are supplied to respective seats, in particular three products, or groups of cigarettes, B, are supplied to three seats of the supply means 20 simultaneously.

The cigarettes are supplied to define corresponding groups of cigarettes starting from respective loading hoppers 121, with the pushing devices of said cigarettes, which extend between a retracted position to pick up the respective group of cigarettes and an advanced position for inserting the respective group of cigarettes into the respective seat.

Said means for providing the product B are provided upstream of said supply means 12, on the opposite side to that of extension of said winding means 10 and of the means for providing the sheet, better described in the remainder of the present description.

As shown, the pick-up position of the product P is angularly spaced substantially by 180° with respect to the position for transfer, or unloading, to the winding means 10.

Moreover, as shown, the pick-up position is a lifted position while the transfer position of the product is a lowered position.

Moreover, there are provided means 11 for supplying the envelope A, which are adapted to arrange said envelopes on said supplying means 20.

Said means 11 for supplying the envelope A are shaped as means adapted to bend the envelope A around, or outside, the product B, or the respective supporting seat 201.

In practice, said means 11 for supplying the envelope are adapted to move said envelope A towards said supplying means 20 and towards said product B.

Said means 11 for supplying the envelope A are adapted to move said envelope A perpendicular to the advancement plane of said advancing means and, in particular, in parallel to the rotation axis R of these supplying means 20.

In particular, said means 11 for supplying the envelope A comprise a shaped seat 111 for engaging the same envelope A in flattened condition and means 112, which are adapted to move said seat 111 towards and away from said supplying means 20, between a retracted position to pick-up the envelope A, in plane condition and an advanced position for passage of the envelope A to the supplying means 20.

Said shaped seat 111 has a "V" configuration, in which the side wings 111*a*, 111*b* are arranged, in condition of passage of the envelope A, around the corresponding faces, or surfaces, of the seat 201 for supporting the product B. As shown, the side, or transverse, wings 111*a*, 111*b* of the seat 111 terminate with perpendicular portions 111'*a*, 111'*b* of contact and pressure against the corresponding external surface of the walls 201*a*, 201*b* of the supplying means 20, in the advanced engaging position.

The shaped seat 111 is also defined by a base 111' for connection to the stem of the respective operating means 112.

The means for providing the envelope A also comprise a respective reel 113 for supporting a strip A' of material defining said envelope, means for unwinding and cutting a sheet A from said strip A', not shown particularly in the accompanying figures, and a pair of small belts 115*a*, 115*b* for holding and advancing the envelope, which extend mutually parallel and move on intermittently moving rollers 115', 115', extending totally, with a portion for supporting the sheet or envelope that is in parallel to the supplying means, in particular to the plate 202 for supporting the seats 201.

The advancing and supporting belts 115*a*, 115*b* are mutually spaced apart and which extend totally radial with respect to the rotation centre R of the supplying means and ensure that the respective sheet is moved from a retracted cutting position to an advanced position for pick-up by said moving seat 111 for inserting the sheet on top of the respective projecting seat 201 of the supplying means.

The means 111 for inserting the envelope move, forwards and backwards, extending between the same holding and advancing belts 115*a*, 115*b*.

Moreover, the means for providing the envelope A comprise a pushing device 117 passing through the hollow bottom of the seat 111 and moving between a retracted position and an advanced position for engaging the sheet on the seat 201 of the supplying means 20.

Figure 7A:
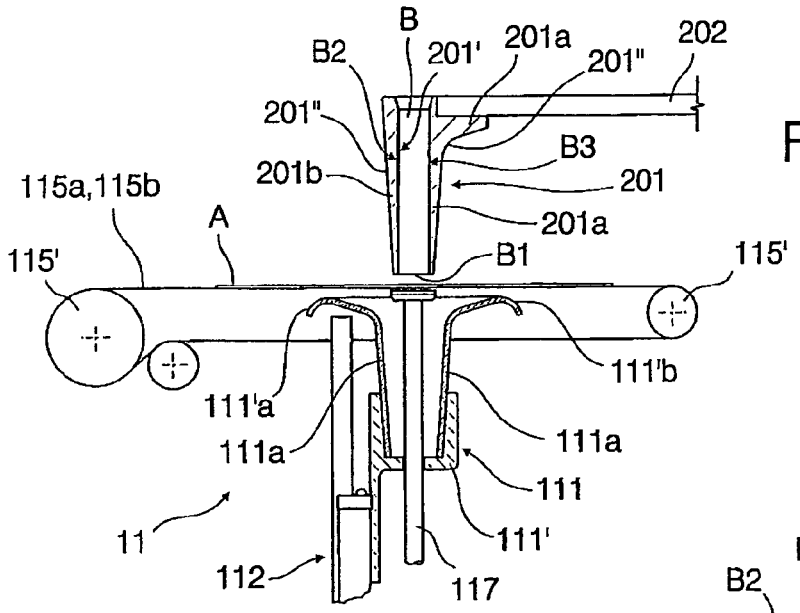
Figure 7B:
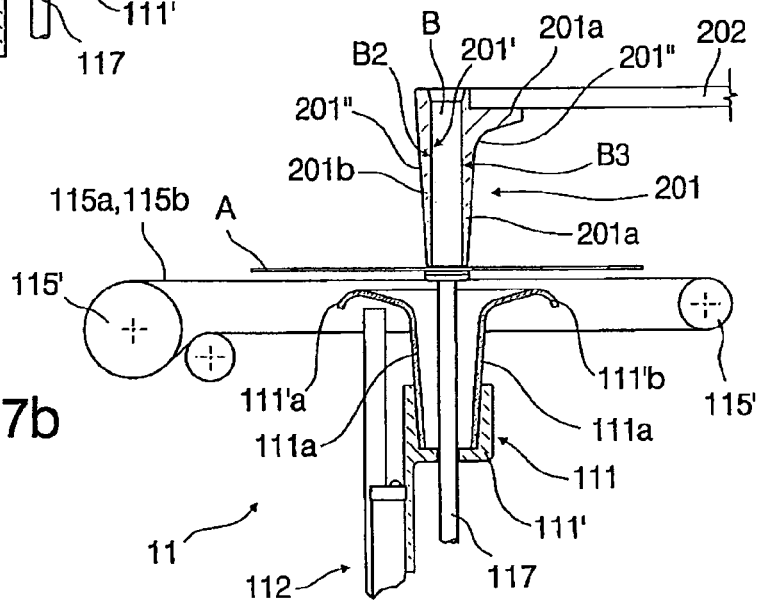

As shown in FIGS. 7*a* to 7*f*, with the cut sheet A supported, in stopped condition, by the holding belts 115*a*, 115*b*, the pushing device 117 advances toward the supplying means, or the seat 201, that carries the product B, and intercepts the envelope A, disengages it from the belts 115*a*, 115*b*, pushing it against the bottom 201'. Of the seat 201, as shown in FIG. 7*b*, thus defining means for engaging the envelope on the bottom, or opposed, end 201' of the seat 201.

Figure 7C:
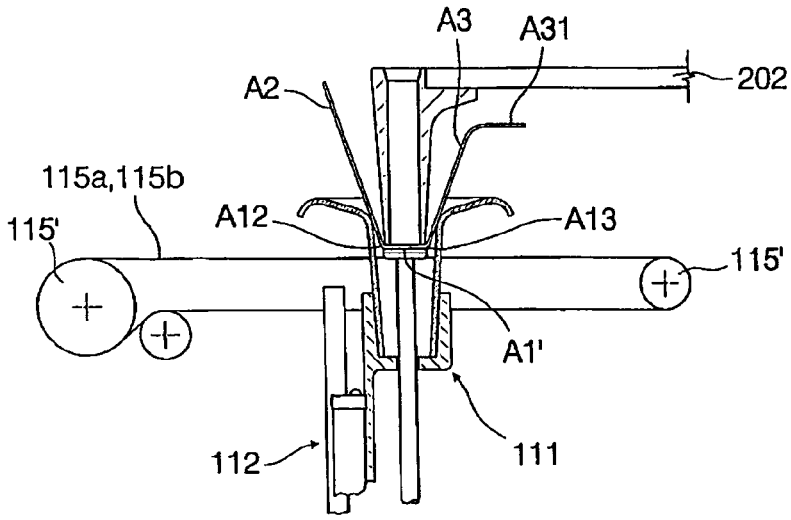

At this point, as shown in FIG. 7*c*, the respective shaped seat 111 advances, with said wings 111'*a*, 111'*b* that engage the envelope A, laterally to the pushing device 117, and push the same envelope A onto the external faces of the circumferential walls 201*a*, 201*b* of the seat, defining said bends, with well-defined profile, A12, A13, and then continue to advance to the position completely superimposed on the seat 210, as shown in FIG. 7*d*, where the principal part 111*a*, 111*b* of the elastic wings of the seat 111 superimposes the external surface of the walls 201*a*, 201*b* of the respective seat 201.

Said wings 111*a* and 11*b* are, advantageously, elastically yieldable outwards, or can be moved away from or towards each other elastically, and define means for compressing the envelope on the respective seat 201.

As shown in the subsequent FIGS. 7*e* and 7*f*, once the envelope A has been completely bent and transferred to the supplying means 20, the seat 111 returns to the retracted position upstream of the belts 115*a*, 115*b* and, therefore, also the pushing device 117 returns to the retracted position inside the seat 111.

In practice, the present means 11 for providing the envelope A define means for bending the envelope, to define a bottom portion A1, that is connected to corresponding side portions A2 and A3 through respective bends, or bending lines, A12, A13.

Moreover, the means 11 for providing the envelope A comprise elastically yielding means, or wings 111*a*, 111*b*, to push the envelope against the supplying means 20, or the seats 201 for containing the product B.

In practice, said seat, or shaped blade, 111, for picking up and inserting the respective sheet held at opposite edges of said radial belts 115*a*, 115*b* is inserted between these belts and is supported by a corresponding stem moved through a corresponding electric motor.

Therefore, the present supplying means 20 move, with intermittent movement, in which advancement steps are alternated with stop steps, during which the product B is inserted into the respective seats, the envelope, or sheet, A is inserted on the respective seat 201 and, as will be more apparent in the remainder of the present description, a corresponding product and relative envelope A are picked up from the supplying means.

In turn, the means 10 for winding the envelope onto the product comprise means 101, 102 for supporting and advancing the product B and the envelope A and means for bending said envelope A around said product B.

In particular, said supporting and advancing means comprise means 101 for supporting 101 the product B and the envelope A, i.e., supporting or bearing means 101, and means 102 for engaging and moving said product B and the corresponding envelope A.

In particular, said means 102 for engaging and moving said product B and envelope A are shaped as means for rear engaging and pushing the product B onto said bearing means 101.

As shown, said means for supporting the product B and the envelope A comprise a narrow bearing and sliding plane 101*a* for the product, which extends linearly.

In particular, said bearing plane 101*a* of the supporting means 101 extends perpendicular to the advancement plane of the supplying means 20 and in parallel to the rotation axis R of the same supplying means 20.

Said means 102 for rear engaging and pushing of the product B onto the bearing means comprise a respective engaging wall 102*a*, that extends transversely, and a respective stem 102*b* for supporting said blade 102*a*, extending substantially vertical or perpendicular from said bearing plane 101*a*, passing between a corresponding longitudinal central slot 101' thereof.

In particular, said means 102 for rear engaging and pushing the product B comprise a plurality of engaging blades 102*a*, equidistant, in particular longitudinally equidistant, from one another.

Said bearing plane 101*a* extends substantially horizontal, between an end upstream for receiving the product B and the envelope A and an end downstream for releasing the product B, in condition wrapped by said envelope A.

In practice, said bearing means 101 extend starting from an end upstream for receiving the product B and the envelope A, which is located substantially at the same level in height as the corresponding supplying means 20 in position for releasing the product B and envelope A.

Therefore, the present winding means are located at a lower level in height than that of the means for providing the cigarettes or product and the means for providing the respective envelope or sheet.

The means for rear engaging and pushing of the product define means for picking up the product and envelope A from the seat 201.

For this purpose, the respective blade 102*a* has a configuration so that it is inserted into the tubular body 201*a* of the seat 201 for supporting the product B, with the corresponding stem 102*b*, which passes through the corresponding longitudinal slot 211 provided in the external wall of said seat 201.

The blade 102*a* enters from the end-upstream of said seats 201 for supporting the product B and for holding the envelope A, engages the rear part of the product B, in particular defined by the filter of the cigarettes, and with the stem 102*b* for supporting the respective engaging blade 102*a* of the product B, which passes through the respective longitudinal slot 211 of the seat 201, exits from the end downstream of the seat 201, with the tip, or front end, B1 of the product B, which engages the bottom portion A1 of the envelope A, drawing it and picking it up from the seat 201.

Therefore, said blade 102*a* defines means for transferring said product B and said envelope A from the supplying means 20 to the winding means 10. As shown, the end upstream of said bearing means 101 extends slightly upstream of said supplying means 20.

It is also possible to provide, as shown, a blade 102*c* for front engaging of said product B and envelope A.

Said front engaging wall is supported on the same supporting stem of the rear engaging blade and is defined in a single body with the front blade.

In particular, the engaging and pushing means are, therefore, defined by a corresponding small front transverse plate for rear engaging of the product and envelope and by a small transverse plate for front engaging of the product and envelope, mutually connected through a corresponding small longitudinal bar 102*d*, supported directly by said perpendicular stem 102*b*.

In practice, the blade means 102 are supported on a corresponding chain, or belt, appropriately mutually spaced apart, said chain, or belt, moving according to an endless path, between corresponding end wheels or pulleys, not shown particularly in the accompanying figures.

Said means 102 for engaging and moving the product B and envelope A have an alternate movement having advancement steps for product and envelope alternated with backward-moving and stop steps.

The backward-moving step has a backward travel of the pushing devices 102*a*, which causes them to exit from the envelope A, to allow the corresponding bends to be produced, as will be more apparent below, with a travel that is less than the distance between one product and the preceding or subsequent product.

In the backward-moving and stop steps, said front engaging means 102*c* can come into contact with the respective product and envelope. In practice, in the backward-moving step of the means for engaging and moving said product, the respective engaging means can be brought into contact with the front face of the product inside the envelope.

The winding means 10 have means that are adapted to bend corresponding edges of the envelope A around the product B.

In particular, said means adapted to bend comprise means 103, which are adapted to bend the side, or transverse, faces A2, A3 of the envelope on the wide side, or transverse, faces B2, B3 of the product B, as shown in FIG. 8*a*.

Figure 9:
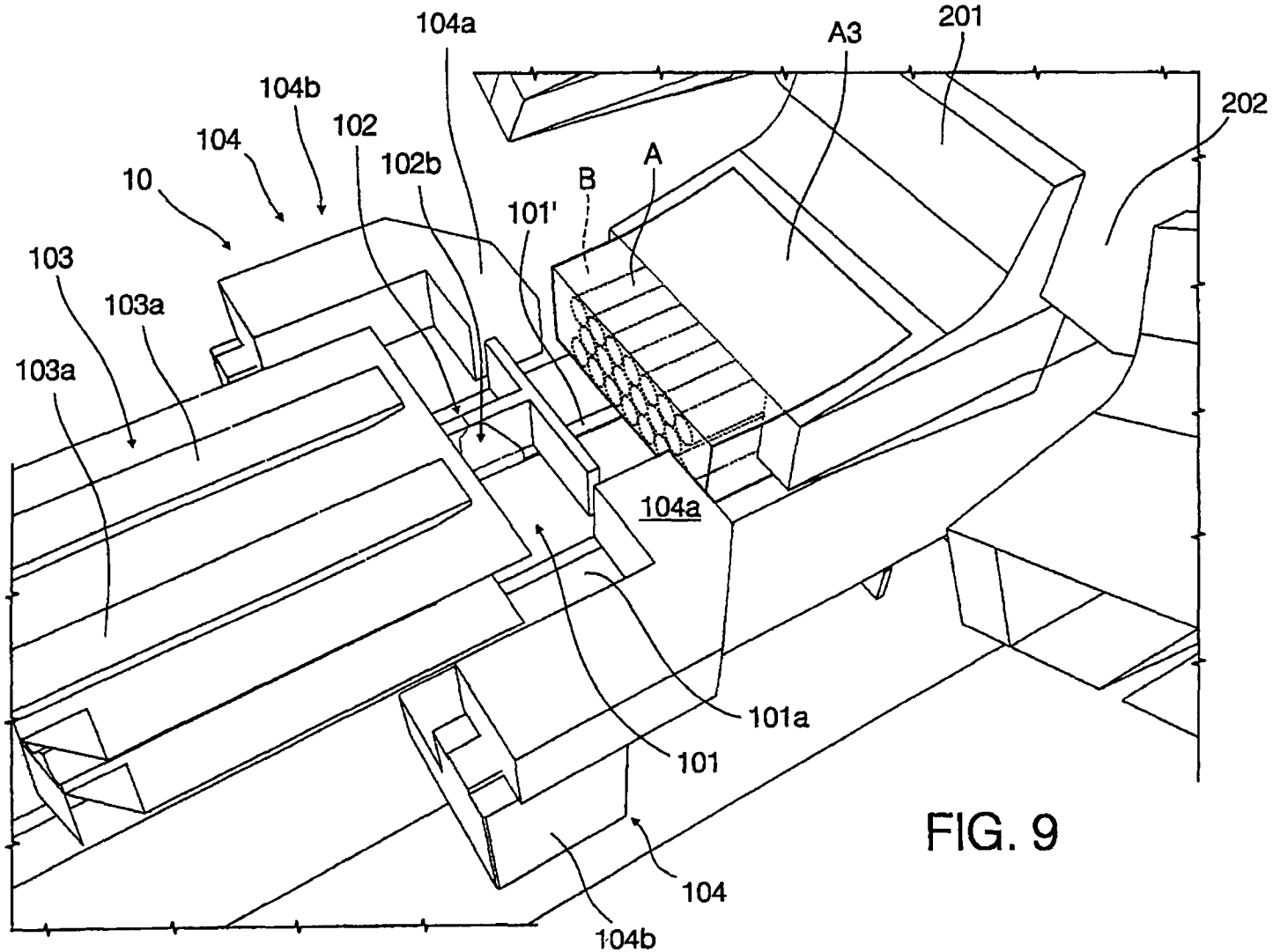
FIG. 9 show a perspective top view of the initial part of the means for winding the envelope on the product.
Figure 10:
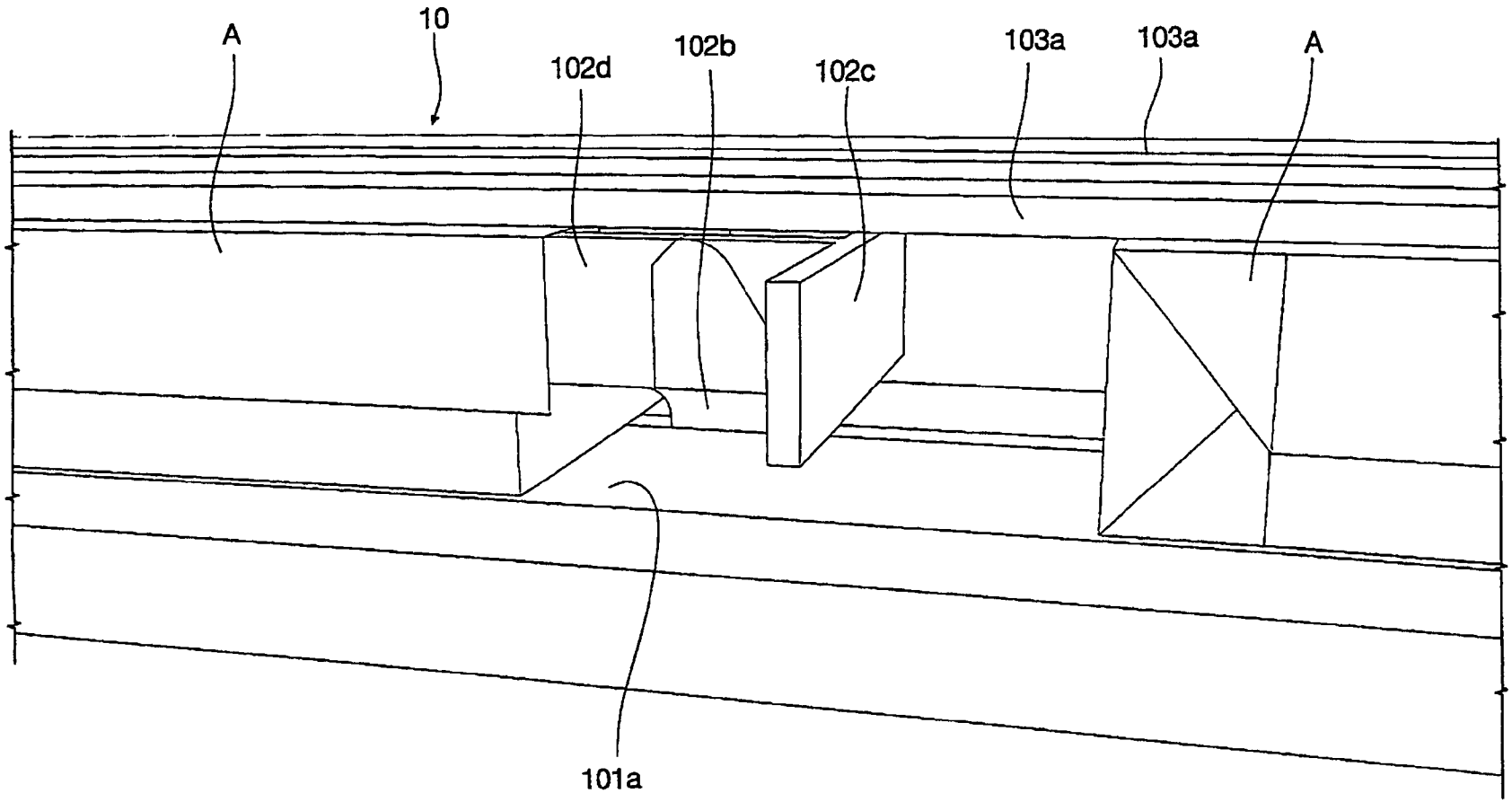
FIG. 10 shows a perspective and enlarged side view of a detail of the central area of the means for winding the envelope on the product.

Said bending means 103 comprise upper longitudinal guide means, in particular composed of two parallel guides 103*a*, 103*a*, shown in particular in FIGS. 9 and 10, and the underlying bearing plane 101*a*.

Due to the push provided to the product B, by the engaging and pushing means 102, bending is obtained of said transverse, or side, faces A3 and A2 of the envelope, which is drawn due to engaging of the front ends B1 of the product with the bottom face A1 of the same envelope, on said upper and lower transverse faces B3, B2 of the product.

Said upper longitudinal guides 103*a*, 103*a*, extend substantially for the entire length of the lower bearing plane 101*a*, defining perpendicular holding means of the product and envelope.

The bending means also comprise means 104 that are adapted to bend the side portions A1', A1", of the bottom edge A1 of said envelope, that project laterally, beyond the side faces B4, B5 of the product, longitudinally on the same side faces B4 and B5, as shown in FIG. 8*b*.

As can be deduced from FIG. 9, said bending means 104 comprise a corresponding engaging projection, or surface, 104*a*, which extends transverse to the longitudinal advancement direction of said product and envelope and which, through interference with the advancing envelope, engages and longitudinally bends the corresponding side portion A1' and A1" of the bottom on the respective side face B4, B5 of the product.

Said means 104, which are adapted to bend the side portions of the bottom of said envelope onto the corresponding side faces of the product, are provided immediately downstream of the exit from the supplying means 20, at or in proximity of the respective seat 201, in position for release of the product.

Said means 104 are shaped as a respective block projecting perpendicularly from the bearing and sliding plane 101*a*. As shown, a first and a second block 104*b*, 104*b* are provided, arranged laterally with respect to a central sliding area of the product and envelope on said plane 101*a* and having projections 104*a*, 104*a*, which extend towards said central sliding area and which are adapted to engage the front face of a corresponding side portion A1', A1" of the bottom A1 of the envelope, which is projecting laterally to the product B.

Moreover, said means adapted for bending comprise means 105 that are adapted to bend corresponding edges A3', A3", A2', A2" of the transverse portions A3, A2 of the envelope, which project laterally beyond the side edges, or side flanks, B4, B5, of the product B on the respective side face of the product B4, B5, in condition of mutual superimposition, defining, as shown in FIG. 8*c*, total side flanks A4 A5 of the envelope.

Said means 105 that are adapted to bend corresponding laterally projecting edges A3', A3", A2', A2" of the transverse portions of the envelope, on the side flank face B4, B5 of the product, are shaped as corresponding guide rods 105*a*, 105*b*, extending laterally to the product and which extend longitudinally to the path of the product, starting from a position perpendicularly spaced from the product to a position on the side flank of the same product.

As shown, for each side flank of the product, there are provided a pair of first guide elements 105*a*, 105*b* for respective upper and lower transverse walls or edges of the envelope, which extend longitudinally for a certain length, and converge in a subsequent longitudinal length 105*c*, positioned in height substantially at the midline of the corresponding side flank of the product, and that is also suitable to maintain the bent condition of the side wings of the envelope bent on the respective side flank of the product.

In practice, for each side flank of the product, an upper guide rod 105*a* is provided, extending upstream perpendicularly spaced from the product, above this product, to intercept the corresponding wing A3' or A3", and which extends longitudinally to a lowered position at the side of the product, bending the same laterally projecting wing A3' or A3" on the respective side of the product.

Moreover, for each side flank of the product, a lower guide rod 105*b* is provided, extending upstream perpendicularly spaced from the product, below this product, to intercept the corresponding wing A2' or A2", and which extends longitudinally to a lifted position at the side of the product, bending the same laterally projecting wing A2' or A2" on the respective side of the product.

Moreover, said means adapted to bend corresponding edges of the envelope of the product B comprise, on the winding means, means 106 that are adapted to bend corresponding end edges A4', A5' of the side edges A4, A5 of the envelope bent on the side flank of the product and which project at the rear beyond the head face B6 of the product, on the same head face B6 of the product B, as shown in FIG. 8*d*.

Said means 106 are shaped as corresponding moving blades 106*a*, 106*a*, moving transversely between a backward position for free passage of the product, in positions mutually moved away and moved away from the central area of the bearing plane 101*a*, and an advanced engaging position of the corresponding side edge of the envelope and of bending thereof on the corresponding head face of the product, wherein the transversely opposite blades 106*a*, 106*a* are positioned close to one another and at the centre of the bearing plane 101*a*.

Figure 6:
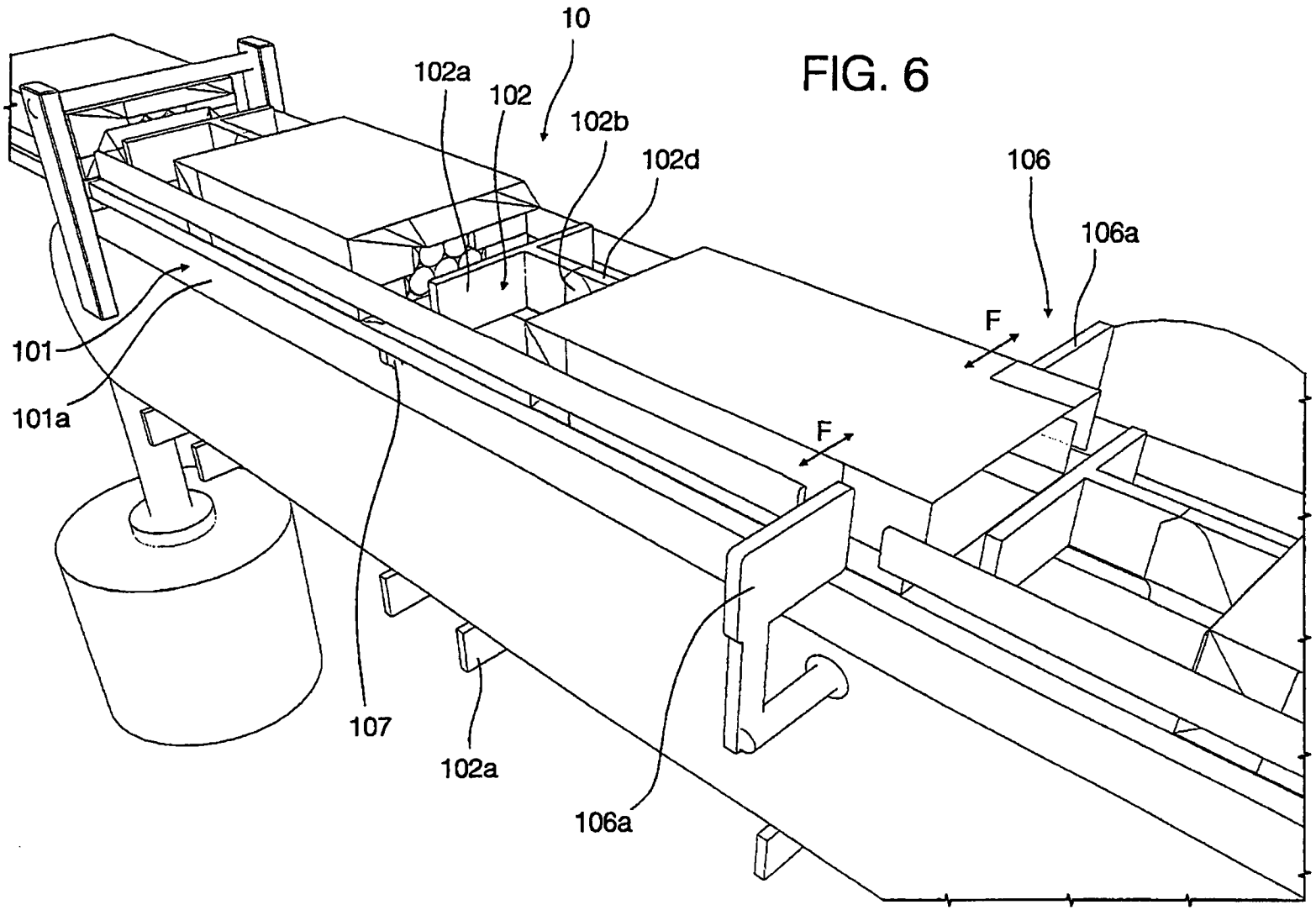
FIG. 6 shows an enlarged view of other components of the present device.

This transverse movement of the blades 106*a*, 106*a* is shown by the arrows F, F of FIG. 6.

As shown, said transverse blades 106*a*, 106*a* are supported, moving transversely, by said bearing means 101, remaining at a level in height above that of the bearing plane 101*a*.

Said transverse blades 106*a*, 106 for bending of the corresponding projecting edge A4', A5' of the side flank of the envelope on the head face B6 of the product, operate when said means 102 for engaging and pushing the product are in longitudinally backward position, i.e. with the product and envelope in stopped condition on the bearing means 101.

Moreover, said means adapted to bend corresponding edges of the envelope around the product B comprise means 107, 108 that are adapted to bend corresponding edges A6' and A6" of the transverse portions, or walls, A2, A3 of the envelope which are projecting longitudinally beyond said head face B6 of the product, on the same head face B6 of the product, superimposed on said portions A4', A5' bent by the projecting side flanks of the envelope through said means 106*a*, 106*a*, as shown in FIGS. 8*e* and 8*f*.

In particular, said means that are adapted to bend a first edge A6' of the lower transverse wall A2 of the envelope A, which projects longitudinally beyond said head face B6 of the product, comprise at least one wing 107, which moves perpendicularly between a lowered position, in which it is under the bearing plane 101*a*, and a lifted position of bending the corresponding edge A6', wherein it projects perpendicularly from said bearing plane 101*a*.

Figure 11:
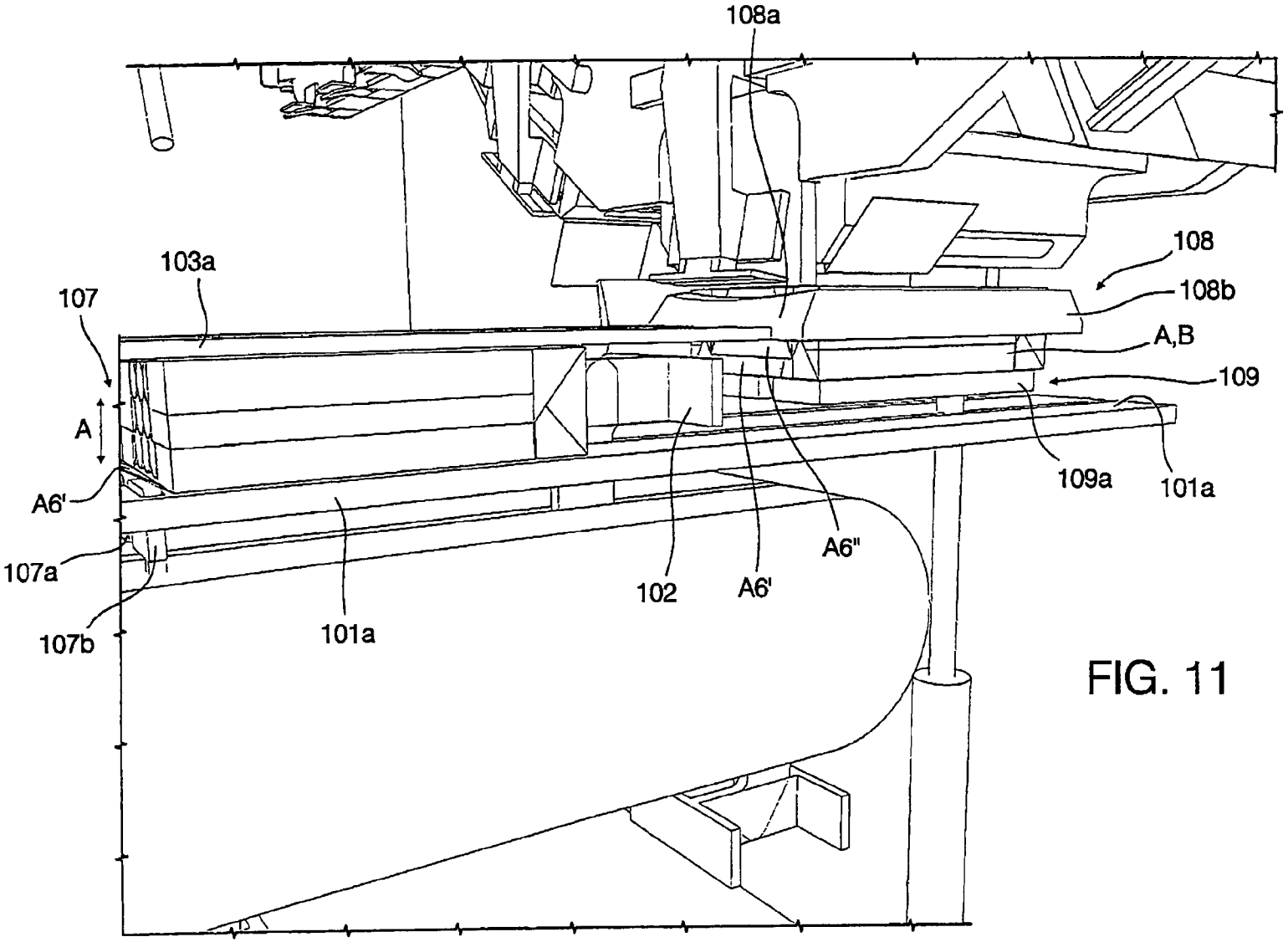
FIG. 11 shows a perspective top view of the terminal part of the means for winding the envelope on the product.

As shown in FIG. 8, in particular, a first and a second transverse wing 107*a*, 107*b* are provided side by side and slightly spaced apart, moving vertically, or perpendicularly, to the plane 101*a*, as shown by the arrow A of FIG. 11.

These perpendicularly moving wings 107*a*, 107*b* also operate when said engaging and pushing means 102 are in backward position, and the product and envelope are stopped on the bearing plane 101.

In practice, the wings 107 are adapted to bend a corresponding projecting edge A6' of the lower transverse wall A2 of the envelope, which is over and in contact with the bearing plane 101*a*.

These bending means 107 are in a station, which is immediately downstream of the station in which the transversely moving means 106 are provided.

Moreover, means 108 are provided that are adapted to bend a second edge A6" of the upper transverse wall of the envelope A3, which projects longitudinally beyond said head face B6 of the product, on the same head face B6 of the product and on the bent edge A6' of the lower transverse face of the envelope, as shown in FIG. 8*f*, which comprise a respective counter surface produced on a crosspiece 108*a* of a hollow quadrangular body 108*b*, arranged downstream of the winding plane and over means 109 for lifting the product and envelope.

Figure 12:
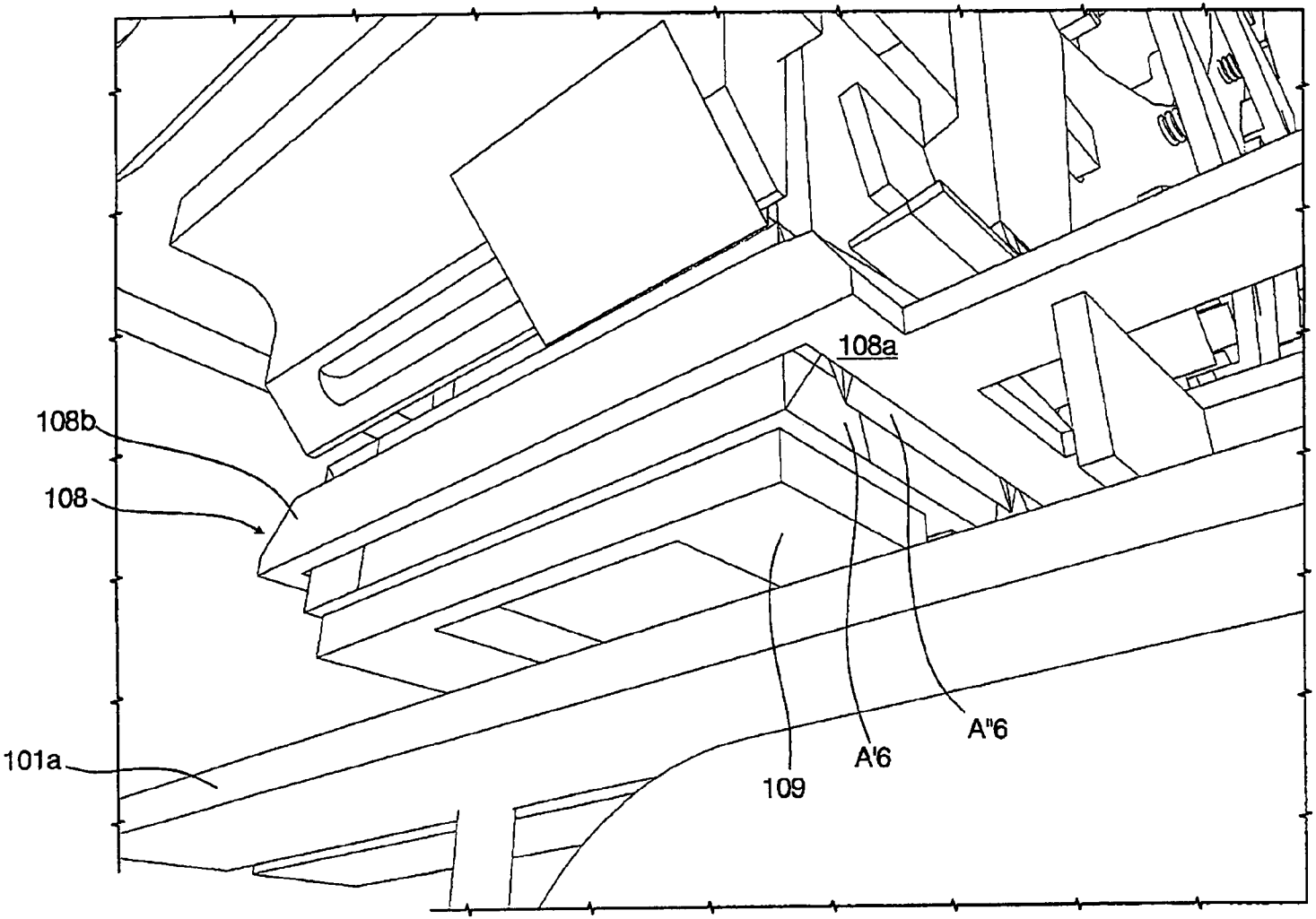
FIG. 12 shows a perspective bottom view of the terminal part of the means for winding the envelope on the product.

In practice, as shown in FIGS. 11 and 12, said quadrangular block 108*b* is provided substantially on the extension of the guides 103*a* at the same level as these and has a vertical through cavity, through which the lifting plane 109 causes the product to pass in wound condition of the envelope A, causing the projecting edge A6" of the envelope to interfere with the crosspiece 108*a* and obtaining relative bending on the head face B6 of the product.

Moreover, means 109 are provided for transferring, or unloading, the product from the winding plane 101*a*, which are shaped as a respective plane 109*a* for receiving the product, which is at the same level of the winding plane 101*a* and is positioned at the downstream longitudinal end of the same winding plane 101*a*.

Said receiving plane 109*a* is moving, starting from said lowered position for receiving the bent product, towards a lifted position, with a movement that takes a corresponding wing A6", not yet bent, of the envelope to interfere with said surface, or crosspiece, 108*a* to produce the last bend of the envelope.

Operation of the present device is, in brief, the following. The group of cigarettes B, which are formed at the base of the respective loading hoppers, through corresponding pushing devices are inserted into a respective tubular seat 201, carried by respective advancing means 202, which are in stopped condition.

By alternating subsequent advancement and stop steps said product, housed inside the respective tubular seat 202, reaches the respective means 11 for applying the envelope A, which apply said envelope A outside the respective seat 202, performing, by opposing of the corresponding transverse, or circumferential, walls of the seat, with a corresponding shaped seat for pick-up and transfer of the envelope, a deformation of the envelope adapted to define corresponding clean and well-defined bending lines A12, A13 provided between the bottom face or portion and the transverse portions of the same envelope. Said application of the envelope around the tubular seat takes place with the advancing means in stopped condition.

In a subsequent step, the product, held inside the seat, and the envelope, held, through corresponding suction means outside the same product, reach a lower release, or unloading, position where in stopped condition, a corresponding engaging and pushing element is inserted, which engages the product, in particular at the relative filter of the cigarettes, pushing it forward to interfere with and pick up the bent sheet, transporting it forwards on said winding means, where, in a first step the projecting side edges of the bottom of the envelope are bent onto the respective side flank face of the product.

In a subsequent step, corresponding shaped guides bend the portions of the transverse walls of the envelope that project laterally beyond the side flanks of the product, on the respective side flank faces of the same product.

Moreover, in a station downstream, means, or blades, moving transversely, bend the side portions, or edges, of the envelope, which are projecting at the rear on the head face of the same product.

After this, in a station downstream, corresponding means, moving perpendicularly, bend a corresponding portion of the transverse lower wall of the envelope, which projects beyond the head face of the product, onto the same head face of the envelope.

Moreover, in a station downstream, through corresponding means for lifting and transporting the product, interfering with a respective crosspiece 108*a*, the remaining projecting edge of the upper transverse wall, or portion, of the envelope is bent onto the respective head face of the product.

The present winding means advance the product and relative envelopes with a trend that provides an advancement step and a stop step, with the respective pushing devices of the products, which have an advancement movement in which they engage and push the respective products forward, a backward-moving step, in which they release the head face of the respective product, to produce corresponding bends, and a stop step, in which bending of the corresponding projecting portions onto the same head face of the product can take place.

With the present device it is possible to produce a system for supplying and bending the envelope onto a respective product, in particular cigarettes, which is greatly simplified with respect to prior art devices.

In particular, with the present device it is possible to perform more or less complete bending of the envelope around the product on a respective longitudinal conveyor, i.e. without the use of corresponding wheels to terminate bending of the envelope and, in any case, in a simplified manner with respect to prior art.

In particular, with the present device an envelope can be positioned on a product with the envelope having respective well-defined bending lines, which greatly facilitate optimal production of the package and thus without the risk of damaging said product, or requiring additional devices for weakening the envelope on the advancing means, as occurs according to prior art devices.

In practice, the present device for packaging cigarettes in bent sheets allows the number of specific components and their arrangement to be reduced, thus achieving considerable savings in production times and costs.

Moreover, the present device is flexible and immediately adaptable to the different final using configurations, without having to readjust a complete packaging line, but simply by replacing a few modular parts on the system.

Moreover, the present device is equipped with a single packaging wheel, and is consequently less complex and costly than systems proposed by prior art.

With reference to the figures, it can be seen that the present device 1 for packaging cigarettes in bent sheets can also comprise, advantageously:

at least a first electric motor (not shown) adapted to move the means 12 for providing cigarettes B;

at least a second electric motor 35 adapted to move the driving means of the belt for the packaging sheets A;

at least a third electric motor 36 adapted to move the supplying means 20;

at least a fourth electric motor 35 adapted to move the supplying means 11;

at least a fifth electric motor (not shown) adapted to move the means for holding the packaging sheets A on the seats 201, after the same sheets A have been placed on said seats 201;

at least a sixth electric motor 39 adapted to move the means for moving the packages, on the winding means;

at least a seventh electric motor 41 adapted to move the means 106 for bending the envelope;

at least an eighth electric motor, not shown in the accompanying figures, adapted to move further means 107 for bending the envelope;

at least a ninth electric motor 45 adapted to lift the packages for the last bend; and electronic control means adapted to control said first, second, third, fourth, fifth, sixth, seventh, eighth and ninth electric motor for electronic movement of the relative motor axes.

Finally, it is obvious that variants of the aforesaid arrangement could be adopted, in which some of the electric motors indicated above can be incorporated in a single motor which performs the operations of the single motors listed, while on the one hand these variants would simplify final production of the system, reducing the number of motors contained therein, on the other hand they would correspondingly reduce the complete flexibility which is the peculiar feature of the system of the invention.

The invention thus conceived is suitable for obvious industrial application; it is also susceptible to numerous modifications and variants, all falling within the inventive concept; moreover, all the details can be replaced by technically equivalent elements.

The invention claimed is:

1. A device for winding an envelope (A) around a product (B), said product (B) being a group of articles shaped as cigarettes, said envelope (A) being shaped as a small plane sheet, the device comprising: winding means for winding (10) said envelope (A) around said product (B); supplying means (20) configured to supply said product (B) and said envelope (A), together, to said winding means (10), said supplying means (20) having seats (201) for supporting the product (B) or the envelope (A) and supporting means (202) for supporting and advancing said seats (201); and envelope supplying means (11) for supplying the envelope (A), said envelope supplying means (11) configured to:

(i) arrange said envelope (A) on the corresponding supplying means (20), (ii) bend the envelope (A) around the product (B), or the respective supporting seat (201), and (iii) move said envelope (A) perpendicularly to an advancement plane defined by the supplying means (20)

wherein said winding means (10) comprise advancing means (101,102) for advancing said product (B) and said envelope (A) and bending means for bending said envelope (A) around said product (B), said advancing means comprising means (101) for resting said product (B) and said envelope (A) and engaging and pushing means (102) for engaging and moving said product (B) and said envelope (A), said means for resting said product (B) and said envelope (A) comprising a resting plane (101*a*) for the product (B) that extends linearly, and said bending means configured to bend corresponding edges of the envelope (A) around the product (B) comprise means (108, 109) configured to bend a corresponding edge (A6") of a second transverse wall (A3) of the envelope longitudinally projecting over a head face (B6) of the product, on the head face (B6) of the product, said means (108, 109) being made as an abutment surface cooperating on a top side with means (109) for lifting product and envelope.

2. The device according to claim 1, wherein said supplying means (20) has engaging and holding means for the respective envelope (A).

3. The device according to claim 1, wherein said seat (201) for supporting the product is shaped as a body defining an internal surface (201') for engaging the product (B) and an external surface (201") for engaging the envelope (A).

4. The device according to claim 1, wherein said supplying means (20) comprise a rotary body (202) supporting a plurality of seats (201) peripherally arranged around said rotary body (202).

5. The device according to claim 1, wherein said envelope supplying means (11) are configured to provide bending lines defining a bottom portion (A1) and corresponding side portions (A2, A3) of the envelope.

6. The device according to claim 5, wherein said envelope supplying means (11) for supplying the envelope (A) are configured to move said envelope (A) in parallel with the rotation axis (R) of the supplying means (20).

7. The device according to claim 5, wherein said envelope supplying means (11) for supplying the envelope (A) comprise a shaped seat (111) for engaging the envelope, in a plane condition, and means (112) configured to move said seat between a position for taking the envelope (A) and a position for passing the envelope (A) to the supplying means (20).

8. The device according to claim 5, wherein said envelope supplying means (11) for supplying the envelope (A) have elastically yieldable means for pushing the envelope against the supplying means (20).

9. The device according to claim 5, wherein said envelope supplying means (11) for supplying the envelope (A) comprise a shaped seat (111) for engaging the envelope and a pushing device (117) passing through the hollow bottom of the seat (111) and moving between a retracted position and an advanced position for engaging the small sheet onto the seat (201) of the supplying means (20).

10. The device according to claim 1, wherein said engaging and pushing means (102) for engaging and moving said product (B) onto said resting means comprise a respective transverse blade (102*a*) configured to engage said product (B) on a rear side thereof, said respective blade (102*a*) being configured to be inserted and passed through the seat (201) of the supplying means (20).

11. The device according to claim 1, wherein said bending means configured to bend comprise means (103) configured to bend side faces (A2, A3) of the envelope on transverse side faces (B2, B3) of the product.

12. The device according to claim 1, wherein said bending means configured to bend comprise means (104) configured to bend side portions (A1', A1") of the bottom of said envelope laterally projecting over side faces (B4, B5) of the product, on the side faces (B4, B5) of the product, said means (104) comprising a corresponding projection (104*a*) for engaging and bending the corresponding side portion (A1', A1") of the bottom of the envelope.

13. The device according to claim 1, wherein said bending means adapted to bend corresponding edges of the envelope (A) around the product (B) comprise means (105) that are adapted to bend corresponding edges (A2', A3', A2", A3") of the transverse portions (A2, A3) of the envelope (A2, A3) that project over the side edges (B4, B5) of the product, on the side face (B4*f* B5) of the product.

14. The device according to claim 1, wherein said bending means configured to bend corresponding edges of the envelope (A) around the product (B) comprise means (106) configured to bend corresponding side flank edges (A4*f*, A5') of the envelope that project over a head face (B6) of the product, on the head face (B6) of the product, said means (106) being made as corresponding transverse blades (106*a*, 106*a*) that are transversally moving between a backward position for freely passing the product, and an advanced engaging and bending position, said means (106) operating when said engaging and pushing means are in a backward position.

15. The device according to claim 1, wherein said bending means configured to bend corresponding edges of the envelope (A) around the product (B) comprise means (107) configured to bend a corresponding edge (A6') of a first transverse wall (A2) of the envelope longitudinally projecting over a head face (B6) of the product, on the head face (B6) of the product, said means (107) comprising at least one blade (107) perpendicularly moving between a lowered position below a bearing plane (101*a*) and a lifted bending position, said means (107) operating when said engaging and pushing means are in a backward position.

* * * * *